US012004634B2

(12) United States Patent
Durham

(10) Patent No.: US 12,004,634 B2
(45) Date of Patent: Jun. 11, 2024

(54) THICK HAIR ELASTIC

(71) Applicant: Durham Enterprises Corporation, Salt Lake City, UT (US)

(72) Inventor: Jeffery S. Durham, Kaysville, UT (US)

(73) Assignee: Durham Enterprises Corporation, Salt Lake City, UT (US)

( * ) Notice: Subject to any disclaimer, the term of this patent is extended or adjusted under 35 U.S.C. 154(b) by 215 days.

(21) Appl. No.: 16/400,031

(22) Filed: Apr. 30, 2019

(65) Prior Publication Data

US 2020/0146416 A1 May 14, 2020

Related U.S. Application Data

(63) Continuation of application No. 29/670,091, filed on Nov. 13, 2018, now abandoned.

(51) Int. Cl.
*A45D 8/34* (2006.01)

(52) U.S. Cl.
CPC ..... *A45D 8/34* (2013.01)

(58) Field of Classification Search
CPC ..... Y10T 24/1408; Y10T 24/1404; Y10T 24/3929; A45D 8/00; A45D 8/34; A45D 8/36; A45D 8/004; A45D 8/001; A45D 2/2464; A41D 23/00
USPC ..... 132/273, 274, 200, 61
See application file for complete search history.

(56) References Cited

U.S. PATENT DOCUMENTS

X536965 4/1895 Neuberger
2,343,408 A 3/1944 Glass
2,468,668 A * 4/1949 Holmes ..... D04B 1/02 66/180
2,643,389 A * 6/1953 Wegner ..... A41D 20/00 2/170
3,099,271 A * 7/1963 Dubelier ..... A45D 8/34 132/273
3,250,095 A * 5/1966 Bird ..... D04B 1/04 66/178 R
4,047,400 A * 9/1977 Thorneburg ..... D04B 1/24 66/171
4,282,727 A * 8/1981 Dunlap ..... D04B 1/26 66/172 E (Continued)

OTHER PUBLICATIONS

George, Christine, "How to Do a Basic Ponytail", Oct. 2017, <https://web.archive.org/web/20171004022650/http://www.wikihow.com/Do-a-Basic-Ponytail#/Image:Do-a-Basic-Ponytail-Step-3-Version-4.jpg> (Year: 2017).*

(Continued)

*Primary Examiner* — Nicholas D Lucchesi
*Assistant Examiner* — Jennifer Gill
(74) *Attorney, Agent, or Firm* — DENTONS Durham Jones Pinegar

(57) ABSTRACT

A thick hair elastic includes a band that comprises a continuous loop. The band may be formed from a yarn that has been woven into the continuous loop or fibers that have been woven into the continuous loop. Opposite edges of the band may be rolled inwardly around a circumference of the band. A central opening of the thick hair band, which is defined by and extends through the band, may have a size sufficient to enable it to be worn around an individual's wrist, like a bracelet. Methods of manufacturing and using thick hair elastics are also disclosed.

5 Claims, 3 Drawing Sheets

(56) References Cited

U.S. PATENT DOCUMENTS

| | | | | | |
|---|---|---|---|---|---|
| 4,499,741 | A * | 2/1985 | Harris | A41D 20/00 | 2/162 |
| 4,732,015 | A * | 3/1988 | Abrams | D04B 1/102 | 66/172 E |
| D315,226 | S * | 3/1991 | Revson | D28/41 | |
| 5,067,177 | A * | 11/1991 | Binder | A41D 27/08 | 2/239 |
| 5,305,470 | A | 4/1994 | McKay | | |
| 5,335,517 | A * | 8/1994 | Throneburg | A41B 11/00 | 2/239 |
| D353,226 | S * | 12/1994 | Nahoum | D28/41 | |
| 5,426,788 | A * | 6/1995 | Meltzer | A41D 20/00 | 2/171 |
| 5,758,671 | A * | 6/1998 | Thim | A44C 5/0053 | 132/273 |
| 5,823,012 | A * | 10/1998 | Hacskaylo | D04B 1/126 | 66/171 |
| D415,313 | S * | 10/1999 | Maturaporn | A45D 8/38 | D28/41 |
| 6,047,708 | A | 4/2000 | Panel et al. | | |
| 6,227,011 | B1 | 5/2001 | Cortinovis | | |
| D450,886 | S | 11/2001 | Sapp | | |
| 6,516,853 | B1 | 2/2003 | Gabrielson et al. | | |
| D581,097 | S * | 11/2008 | Herman | D04B 1/126 | D28/41 |
| D666,262 | S * | 8/2012 | Clausen | D21/752 | |
| D666,770 | S | 9/2012 | Hsu | | |
| D669,218 | S * | 10/2012 | Tsai | D28/41 | |
| 9,055,800 | B2 | 6/2015 | Harvie | | |
| 9,173,467 | B2 | 11/2015 | Passarello | | |
| D780,376 | S * | 2/2017 | Johnson | D28/41 | |
| D789,237 | S | 6/2017 | Chung | | |
| 9,775,413 | B1 | 10/2017 | Ingimundarson et al. | | |
| D812,300 | S | 3/2018 | Conway | | |
| D832,512 | S * | 10/2018 | Hsu | D28/41 | |
| D859,742 | S | 9/2019 | Harrel | | |
| 10,709,222 | B2 | 7/2020 | Harvie | | |
| D893,802 | S | 8/2020 | Luo | | |
| 10,897,974 | B2 | 1/2021 | Passarello | | |
| 10,939,737 | B2 | 3/2021 | Nicholas et al. | | |
| 2007/0094768 | A1 | 5/2007 | Moudgill | | |
| 2010/0242980 | A1* | 9/2010 | D'Assis | A45D 8/36 | 132/200 |
| 2011/0253159 | A1* | 10/2011 | Stachowski | A45D 8/36 | 132/200 |
| 2012/0211021 | A1* | 8/2012 | Hsu | A45D 8/38 | 132/276 |
| 2014/0048094 | A1* | 2/2014 | Carriedo | A45D 8/00 | 132/210 |
| 2014/0250566 | A1 | 9/2014 | Stegerhoek | | |
| 2014/0318180 | A1 | 10/2014 | Cabe | | |
| 2015/0335124 | A1 | 11/2015 | Passarello | | |
| 2020/0138162 | A1 | 5/2020 | Sze | | |
| 2020/0146416 | A1 | 5/2020 | Durham | | |
| 2020/0196690 | A1 | 6/2020 | Sohn | | |
| 2020/0196730 | A1 | 6/2020 | Abualhaija | | |

OTHER PUBLICATIONS

Elastic Hair Ties J-MEE 30 Count Thick Hair No Slip Damage Glitter Hair accessories Rubber bands, announced Dec. 17, 2016 [online], retrieved Sep. 9, 2020, retrieved from internet, https://www.amazon.com/gp/product/B01N3X819/?tag=hairaccessorites-20.

Elastic Hair Ties J-MEE 30 Count, announced Dec. 17, 2016 [online], retrieved Dec. 23, 2019, retrieved from internet, https://www.amazon.com/gp/product/B01N3YX8L9/?tag=hairaccessories-20&pbc=160417063032.

Frcolor 190 Pieces Hair Elastics Hair Ties Hair Bands Bulk Ponytail Holders, announced Oct. 25, 2017 [online], retrieved Sep. 9, 2020, retrieved from internet, https://www.amazon.com/dp/B07R7LP8G/ref=sspa_dk_detail_2?psc=1&pd_rd.

Tiny Expressions, announced Mar. 21, 2018 [online], retrieved Sep. 9, 2020, retrieved from internet, https://www.amazon.com/Tiny-Expression-Embroidered-Baseball-Monogrammed/dp/B07BN3W72J/REF=SR_1_43?dchild=1&keywrods=%22G%22%2BHAT&qid=1599674097&sr.

Gimme Bands—Like No Other Hair Band, announced Oct. 22, 2018 [online[, retrieved Sep. 9, 2020, retrieved from internet, https://www.youtube.com/watch?v=RVSSLX74rT0.

Gimme Bands—Starter Kit, announced Aug. 2, 2019 [online[, retrieved Sep. 9, 2020, retrieved from internet, https://gimmebeauty.com/products/gimme-bands-starter-kit.

Gimme Bands No Break Thick Hair Ties, announced Jan. 9, 2019 [online], retrieved Sep. 9, 2020, retrieved from internet, https://www.amazon.com/GIMME-Bands-Breaks-Thick-Chestnut/dp/B07KXBSSWS?th=1.

* cited by examiner

THICK HAIR ELASTIC

CROSS-REFERENCE TO RELATED APPLICATION

A claim for the benefit of priority to the Nov. 13, 2018 filing date of U.S. Design patent application Ser. No. 29/670,091, titled HAIR ELASTIC ("the '091 Design application"), is hereby made. The entire disclosure of the '091 Design application is hereby incorporated herein.

TECHNICAL FIELD

This disclosure relates to accessories for hair, and more specifically, to elastics that are capable of holding gathered hair, such as ponytails. More specifically, this disclosure relates to elastics that have configurations that enable them to be used to hold hair gathered into thick groupings together.

RELATED ART

Elastics, which are also commonly referred to as "rubber bands," have long been used to hold gathered hair together. Conventional elastics typically comprise a loop, or band, of an elastic, resilient material. Elastic, resilient materials are often referred to as "elastomeric materials" or, more simply, as an "elastomers." The elastomer of an elastic may be exposed or covered with a fabric.

Conventional elastics typically have sizes that range from about a half an inch in diameter to about an inch and a half in diameter. When used to hold hair together, conventional elastics are often doubled over (i.e., the elastic is twisted into a FIG. 8 configuration, and then both halves are then superimposed with one another), tripled over, etc., to reduce their diameters. The reduced diameter of an elastic is intended to enable it to firmly grasp the gathered hair, and to prevent it from falling off of the gathered portion of the hair, or out of the hair. However, conventional elastics do often slide off of thin, fine hair. Conventional elastics can also be too small to fit around coarse, tightly curled hair, braids (e.g., cornrow braids, etc.), dreadlocks, and the like, that have been gathered together.

Although conventional elastics are suitable for holding the majority of gathered hair, they often snag the hair as an individual removes them from his or her hair.

SUMMARY

A hair elastic according to this disclosure has a configuration that enables it to hold thick gatherings of hair together. Such an elastic may be referred to as a "thick hair elastic." Without limitation, a thick hair elastic may be used to hold coarse, tightly hair that has been gathered, braids (e.g., cornrow braids, etc.) that have been gathered, and gathered dreadlocks.

Such a thick hair elastic may comprise a band, or loop, with a relatively large diameter. The band is, of course, elastic. The band of the thick hair elastic may comprise a continuous band that lacks any seams or other features that would indicate that two ends of an elongated member have been joined together. In a specific embodiment, the band may be formed from a knitted or woven material (e.g., yarn, thread, etc.). The knit or weave of the material may impart the thick hair elastic with at least some of its stretchability and resilience. At least some of the stretchability and resilience of the thick hair elastic may be due to the material (e.g., fibers, etc.) from which the thick hair elastic is formed.

The thick hair elastic may have a surface that is consistent or smooth over its entirety. Thus, the thick hair elastic may lack ribs or other features that provide discontinuities in the surface of the thick hair elastic. In knitted embodiments, the knitting of the thick hair elastic may be consistent across an entirety of the thick hair elastic. In embodiments where the thick hair elastic is formed from a woven material, the weave may be consistent across an entirety of the thick hair elastic.

In embodiments where the band of the thick hair elastic is knitted from yarn, a yarn having a weight of 1 (super fine) (e.g., fingering yarn, sock yarn, etc.) (350 m/100 g to 600 m/100 g) or a weight of 2 (fine) (e.g., sport yarn, baby yarn, etc.) (250 m/100 g to 350 m/100 g) may be used. The width of each knit may be at least about twice the diameter of the yarn. The same proportions may apply to woven materials from which the band of a thick hair elastic may be formed. By maintaining such proportions, in combination with its inwardly rolled configuration, the thick hair elastic may be capable of assuming and/or maintaining its intended shape (e.g., a toroid, or doughnut, shape; etc.) when resting upon a surface for a prolonged period of time (e.g., several minutes, an hour or more, a day or more, a week or more, etc.).

The band may be circumferentially rolled upon itself. As an example, opposite edges of the band may be rolled circumferentially inward. Such a configuration may impart the thick hair elastic with strength, resilience, and/or an ability to grasp the gathered hair around which the thick hair elastic is placed.

A method of manufacturing a thick hair elastic according to this disclosure may include defining a tube. Without limitation, the tube may be formed by knitting a yarn or another suitable fiber into the shape of a continuous (i.e., seamless) tube. The tube may comprise a relatively short tube with a relatively large diameter. Alternatively, the tube may comprise an elongated tube that is then cut transversely to its length to define a plurality of shorter tubes that may then define a corresponding plurality of thick hair elastics. The knit and/or the fibers from which the tube is formed may cause its opposite ends to roll inwardly upon themselves, thereby defining a thick hair elastic.

Use of a thick hair elastic may include introducing an individual's hand into a central opening through the thick hair elastic. Introduction of the individual's hand into the central opening may stretch the material of the thick hair elastic and increase the size of the central opening somewhat. The individual's hand (e.g., his or her fingers, etc.) may also be spread apart to further stretch the material of the thick hair elastic and to further increase the size of the central opening. When the size of the central opening has been sufficiently increased, the thick hair elastic may be positioned over gathered hair; i.e., the gathered hair may be introduced into the central opening. The thick hair elastic may then be released by the individual's hand, and positioned at a desired location along the gathered hair. If desired, the thick hair elastic may be doubled, tripled, etc., to ensure that it remains in place on the gathered hair.

Other aspects of the disclosed subject matter, as well as features and advantages of various aspects of the disclosed subject matter, should become apparent to those of ordinary skill in the art through consideration of the ensuing description, the accompanying drawings, and the appended claims.

DETAILED DESCRIPTION

An embodiment of a thick hair elastic 10 according to this disclosure is depicted by FIGS. 1-7. The thick hair elastic 10 includes a band 12 that defines a central opening 14. The band 12 is stretchable and resilient. By stretching the band 12, the size of the central opening 14 may be enlarged.

Figure 8:
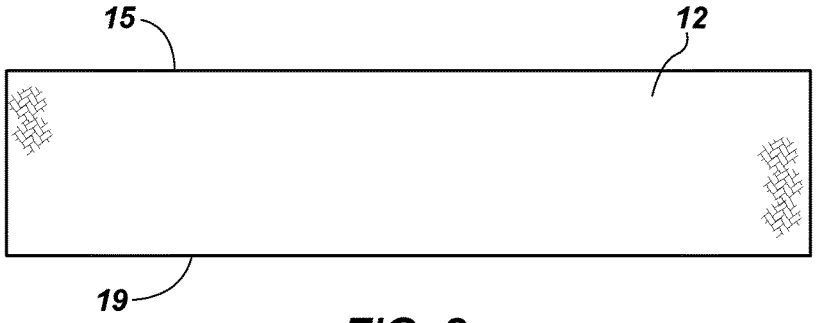
FIG. 8 shows an embodiment of thick hair elastic in a state where its edges are unrolled.

As shown in FIGS. 1-7, as well as in FIG. 8, the band 12 may be formed from a cylindrical element. The tubular or cylindrical element may comprise a continuous loop and, thus, may lack a seam or a knot. In embodiments where the band 12 is formed from a knitted yarn or fabric, the fibers (e.g., threads, etc.) that make up the yarn or fabric may be knitted or woven in a manner that provides the loop with continuity. In some embodiments, the band 12 may consist of knitted yarn or fabric.

The thick hair elastic may have a surface that is consistent or smooth over its entirety. Thus, the thick hair elastic may lack ribs or other features that provide discontinuities in the surface of the thick hair elastic. In knitted embodiments, the knitting of the thick hair elastic may be consistent across an entirety of the thick hair elastic. In embodiments where the thick hair elastic is formed from a woven material, the weave may be consistent across an entirety of the thick hair elastic.

In embodiments where the band 12 of the thick hair elastic 10 is knitted from yarn, a yarn having a weight of 1 (super fine) (e.g., fingering yarn, sock yarn, etc.) (350 m/100 g to 600 m/100 g) or a weight of 2 (fine) (e.g., sport yarn, baby yarn, etc.) (250 m/100 g to 350 m/100 g) may be used. The width of each knit may be at least about twice the diameter of the yarn. As an example, a yarn that has a diameter of about 1/22 of an inch may have a knitting gauge of at least about 11 knits per inch (e.g., 11 knits per inch, 12 knits per inch, 13 knits per inch, etc.). As another example, a yarn that has a diameter of about 1/25 inch may have a knitting gauge of at least about 12½ knits per inch.

Friction between a thick hair elastic 10 that has been formed from knitted yarn or fabric and an individual's hair may enable the thick hair elastic 10 to remain in place along the gathered hair. Knitted yarn or fabric (e.g., a knit or weave that is consistent across the entirety of the band 12, etc.) may prevent the thick hair elastic 10 from snagging hair as an individual removes it from his or her hair. The knitted yarn or a fabric used to define the thick hair elastic 10 may be washable, making the thick hair elastic washable.

A knit of knitted embodiments of the band 12 or a weave of fabric embodiments of the band 12 may at least partially impart the band with its stretchability and resilience. At least a portion of the stretchability and resilience of the band 12 may be provided by the fibers that define the yarn or fabric from which the band 12 is formed (e.g., at least some of the fibers may comprise elastic fibers, etc.). In some embodiments, a combination of the knit or weave and the material from which the band 12 is formed may render the band 12 stretchable and resilient. The band 12 may be capable of elongation by at least twice its relaxed length. In some embodiments, the band 12 may be capable of elongation by at least three times its relaxed length.

Figure 1:
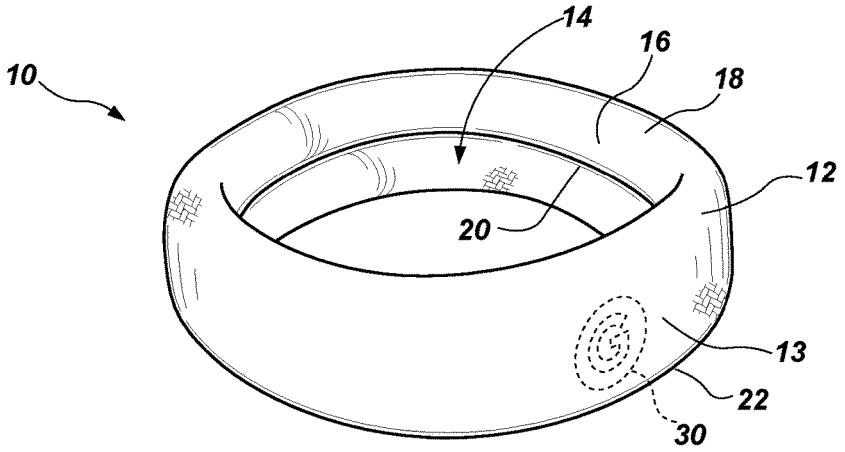
FIG. 1 is a perspective view of an embodiment of a thick hair elastic according to this disclosure.
Figure 2:
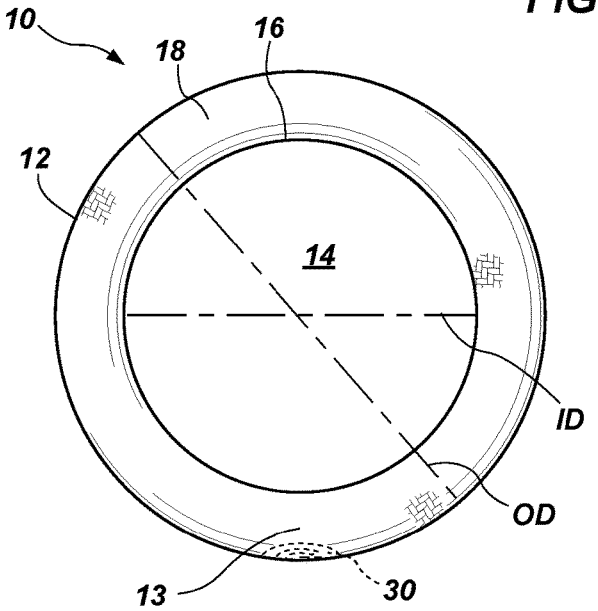
FIG. 2 is a top view of the embodiment of thick hair elastic shown in FIG. 1.
Figure 3:
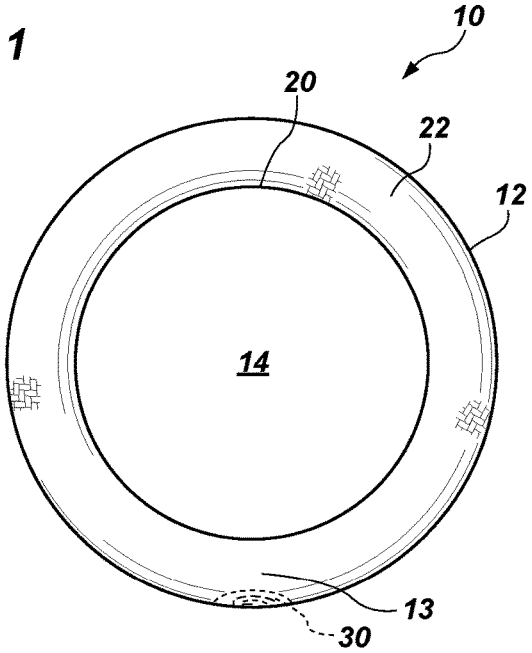
FIG. 3 is a bottom view of the embodiment of thick hair elastic shown in FIG. 1.
Figure 4:
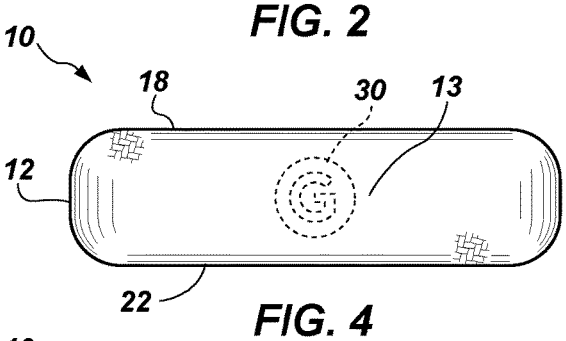
FIG. 4 is a front elevational view of the embodiment of thick hair elastic shown in FIG. 1.
Figure 5:
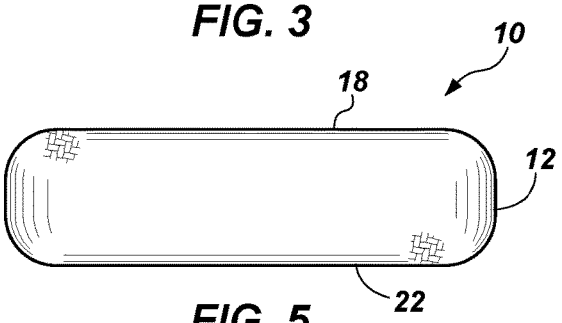
FIG. 5 is a rear elevational view of the embodiment of thick hair elastic shown in FIG. 1.
Figure 6:
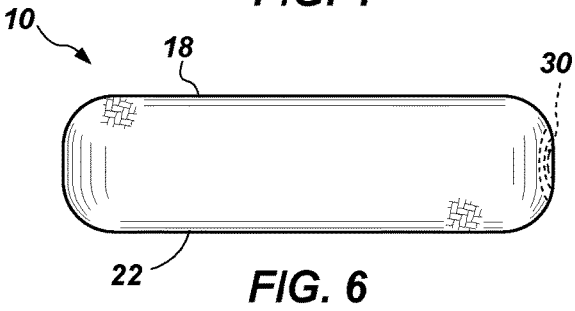
FIG. 6 is a first side elevational view of the embodiment of thick hair elastic shown in FIG. 1.
Figure 7:
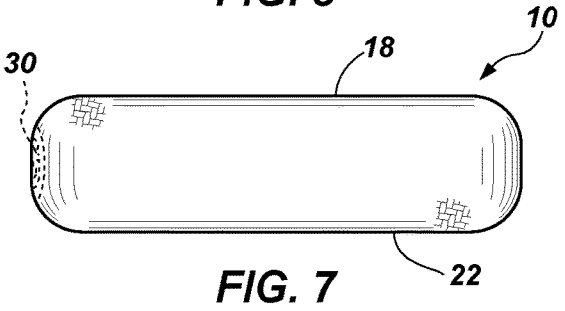
FIG. 7 is a second side elevational view of the embodiment of thick hair elastic shown in FIG. 1.

Edges 15 and 19 at opposite ends of the cylindrical element that defines the band 12, which can be seen in the arrangement depicted by FIG. 8, may roll inwardly upon themselves around the circumference of the cylindrical element in the manner shown in FIG. 1. Such inward rolling may impart the thick hair elastic 10 with configuration shown in FIGS. 1-7. These inwardly rolled edges 16 and 20 contribute to the overall thickness of the band 12 and, thus, to the overall thickness of the thick hair elastic 10. The inwardly rolled edges 16 and 20 may also contribute to a strength and resilience of the thick hair elastic 10 (e.g., it may resist breaking better than conventional elastics, it may retain its hold around gathered hair or other items for pronged periods of time (e.g., 8 hours, 12 hours, 16 hours, 20 hours, 24 hours, etc.), etc.), as well as its ability to grasp gathered items, such as gathered hair. The inwardly rolled edges 16 and 20 also impart the thick hair elastic 10 with rounded edges 18 and 22.

A configuration of the thick hair elastic 10 may prevent it from creasing or denting an individual's hair, even after the thick hair elastic 10 has been worn in the individual's hair during physical exercise or for prolonged periods of time (e.g. an hour or more, two hours or more, six hours or more, eight hours or more, overnight; etc.).

The thick hair elastic 10 may have a relatively large diameter. In its relaxed state, an outer diameter OD of the thick hair elastic 10 may be about two inches (about 5 cm) or more (e.g., 2¼ inches (about 5.7 cm), about 2½ inches (about 6.3 cm), about three inches (about 7.5 cm) etc.). An inner diameter ID of the band 12 and, thus, a diameter of the central opening 14, may be sufficient to enable the thick hair elastic 10, alone or in combination with a material and/or a weave of the band 12, to be worn comfortably around the wrist of an individual (e.g., an adult female of average size, an adult male of average size, etc.). Without limitation, the inner diameter ID of the band 12 may be at least about 1½ inches (about 3.8 cm) (e.g., about two inches (about 5 cm), about 2¼ inches (about 5.7 cm), about 2½ inches (about 6.3 cm), etc.). When the band 12 is expanded, its outer diameter OD may expand to about four inches (about 10 cm) or more (e.g., about six inches (about 15 cm), about seven inches (about 17.5 cm), about 7½ inches (about 18.8 cm), about eight inches (about 20 cm), etc.).

In a specific embodiment, the band 12 of the thick hair elastic 10 may be formed from a 2 weight (fine) sport yarn having a diameter of about 1/22 of an inch (about 1.2 mm) and a knitting gauge of about 11 knits per inch (i.e., about 4 knits per centimeter, or each knit may have a width of about 2.5 mm). The thick hair elastic 10, in its relaxed, rolled state, may have an outer diameter OD of about 2¼ inches (about 5.7 cm), a band 12 thickness of about one-fourth of an inch (about 6 mm), an inner diameter ID (or a central opening 14 with a diameter) of about 1¾ inches (about 4.5 cm), and a width (or cylindrical height) of about five-eighths of an inch (about 1.6 cm). The unrolled width (or cylindrical height) of the band 12 (see FIG. 8) may be about 1⅝ inches (about 4.1 cm). Such a size may enable an individual to comfortably wear the thick hair elastic 10 as a bracelet around his or her when the thick hair elastic is not being used in his or her hair, making the thick hair elastic 10 readily available when the individual chooses to use it.

As depicted by FIGS. 1-4, the band 12 of a thick hair elastic 10 according to this disclosure may include a design element 30 on its outer surface 13. The design element 30 may be visibly distinct from the outer surface 13 of the band 12. As an example, the design element 30 may have a color that renders it visible. In some embodiments, the design element 30 may be fluorescent or phosphorescent (i.e., it may glow in the dark). The design element 30 may comprise an icon, a logo, text, or the like.

Figure 9:
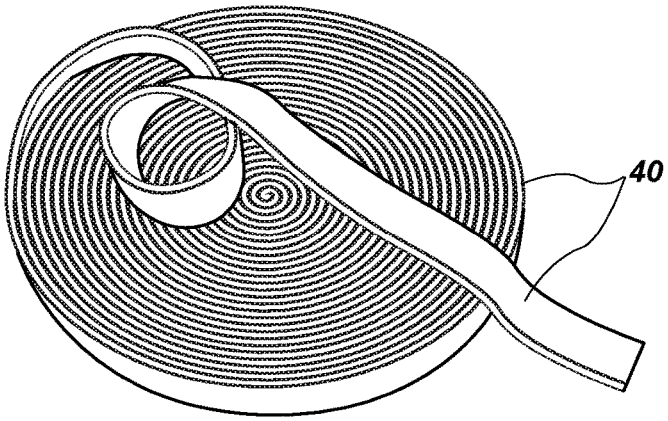
FIG. 9 shows an embodiment of a tube from which a plurality of thick hair elastics may be defined.
Figure 10:
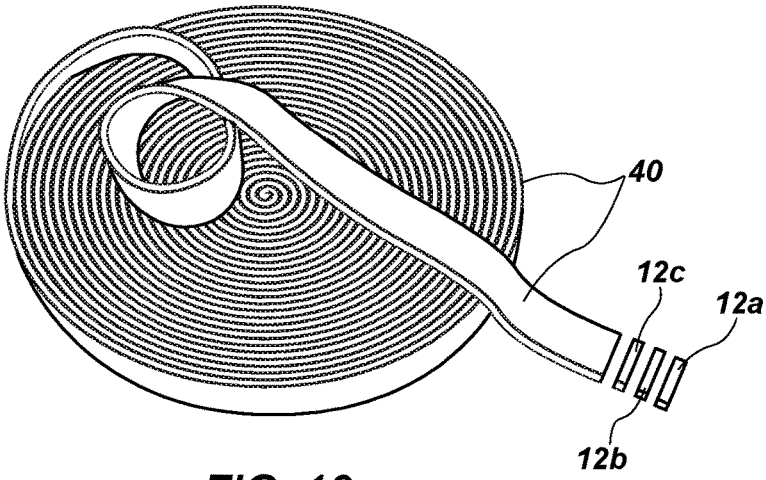
FIG. 10 represents separation of individual bands from the tube of FIG. 9.

The embodiment of band 12 shown in FIG. 8 may be manufactured independently from the bands 12 that define other thick hair elastics 10 (FIGS. 1-7). Alternatively, as depicted by FIGS. 9 and 10, an elongated tube 40 may be defined (e.g., by knitting, weaving, etc.), and then separated (e.g., cut, etc.) into a plurality of bands 12*a*, 12*b*, etc., each of which may then define a thick hair elastic 10.

Figure 11:
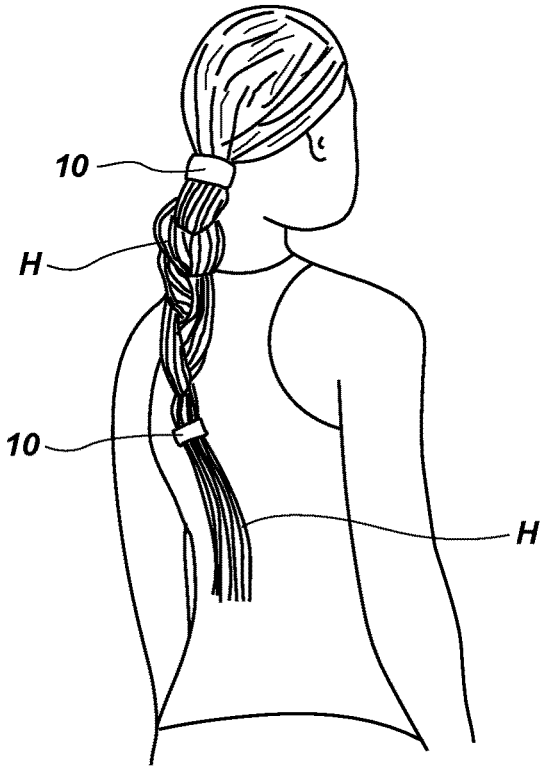
FIGS. 11 and 12 respectively show examples of use and removal of a thick hair elastic.

Turning now to FIG. 11, and with returned reference to FIG. 1, an embodiment of use of a thick hair band 10 is described. The thick hair band 10 may be retrieved from a stored location. As an example, the thick hair band 10 may be removed from an individual's wrist. An individual's hand may be introduced into the central opening 14 of a thick hair elastic 10. Introduction of the individual's hand into the central opening 14 may stretch the material of the band 12 that defines the thick hair elastic 10 and increase the size of the central opening 14 somewhat. The individual's hand (e.g., his or her fingers, etc.) may also be spread apart to further stretch the material of the band 12 to further increase the size of the central opening 14.

When the size of the central opening 14 has been sufficiently increased, at least some of the individual's hair H may be pulled together, providing gathered hair H. The thick hair elastic 10 may be positioned over gathered hair H; i.e., the gathered hair H may be introduced into the central opening 14 of the thick hair elastic 10. The thick hair elastic 10 may then be released by the individual's hand, and positioned at a desired location along the gathered hair. A material from which the thick hair elastic 10 is made may grasp the gathered hair H. If desired, and as shown in FIG. 11, the thick hair elastic 10 may be doubled at least once, tripled, etc., to ensure that it remains in place on the gathered hair H.

Figure 12:
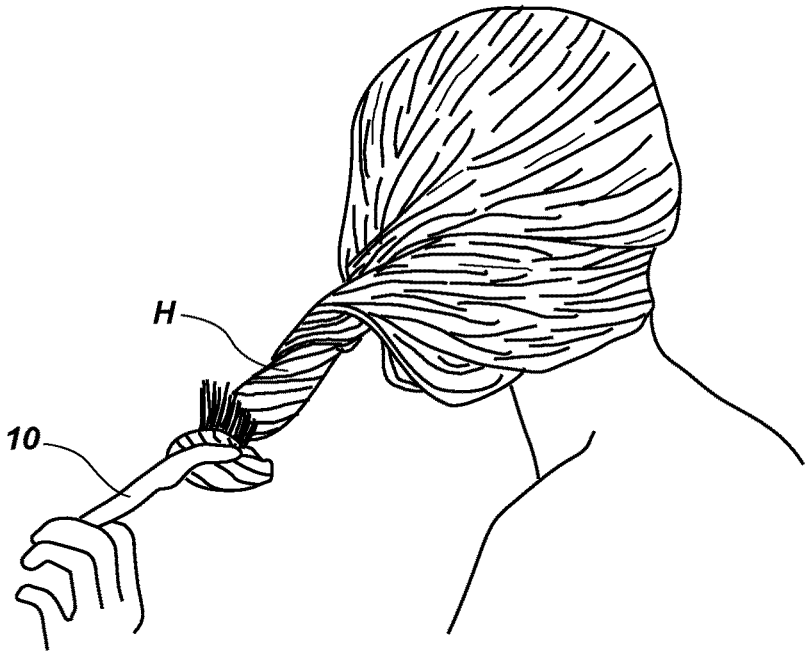

Once use of the thick hair elastic 10 is no longer desired, it may be removed from the gathered hair H simply by pulling on it, as illustrated by FIG. 12. Once the thick hair elastic 10 has been pulled from the gathered hair H, the thick hair elastic 10 may be stored, such as by placing it on an individual's wrist (e.g., the wrist of the individual from whose hair the thick hair elastic 10 has been pulled, etc.). If the thick hair elastic has become soiled, such as by oil from the individual's hair, sweat or other contaminants (e.g., dandruff, etc.) from the individual's scalp, and/or styling products from the individual's hair, it may be washed before it is used again.

Other aspects of the disclosed subject matter, as well as features and advantages of various aspects of the disclosed subject matter, will become apparent to those of ordinary skill in the art though consideration of this disclosure, the accompanying drawing, and the appended claims.

What is claimed:

1. A method for holding hair in a gathered arrangement, comprising:

wearing a thick hair elastic around a wrist of an individual until use of the thick hair elastic in hair of the individual is desired, the thick hair elastic consisting of a band defined by a continuous loop with a knit and/or fibers causing opposite edges of the continuous loop to roll repeatedly inward upon themselves and toward each other to define two oppositely rolled portions defining rounded edges of the band, the band also including a central opening with a relaxed inner diameter of at least an inch and a half;

removing the thick hair elastic from the wrist;

placing a hand of the individual within the central opening of the thick hair elastic;

stretching the band of the thick hair elastic and increasing a size of the central opening to an inner diameter of about four inches or more with the hand;

pulling at least some of the hair of the individual together to provide gathered hair;

placing the central opening of the thick hair elastic over and around the gathered hair; and releasing the thick hair elastic onto the gathered hair.

2. The method of claim 1, further comprising:

doubling the thick hair elastic at least once to tighten a grasp of the thick hair elastic on the gathered hair.

3. The method of claim 1, further comprising:

pulling the thick hair elastic from the gathered hair to remove the thick hair elastic from the gathered hair without snagging or pulling the gathered hair.

4. The method of claim 3, further comprising:

replacing the thick hair elastic on the wrist of the individual.

5. The method of claim 3, further comprising:

washing the thick hair elastic.

* * * * *